US005244445A

United States Patent [19]

Amesquita

[11] Patent Number: 5,244,445

[45] Date of Patent: Sep. 14, 1993

[54] EXERCISE WAND AND METHOD

[76] Inventor: Robert Amesquita, 1954 N. Raymond Ave., Pasadena, Calif. 91103

[21] Appl. No.: 573,497

[22] Filed: Aug. 27, 1990

Related U.S. Application Data

[63] Continuation-in-part of Ser. No. 885,222, Jul. 14, 1986, abandoned.

[51] Int. Cl.[5] ..... A63B 21/22

[52] U.S. Cl. ..... 482/110; 482/109; 482/148

[58] Field of Search ..... 272/122, 123, 117, 93, 272/96, 128, 67; 273/96; 482/10, 93; 45/105, 106, 108, 109, 110, 148

[56] References Cited

U.S. PATENT DOCUMENTS

| | | | |
|---|---|---|---|
| 2,509,810 | 5/1950 | Core | 272/128 |
| 2,521,336 | 9/1950 | Bramson | 272/117 |
| 3,006,646 | 10/1961 | Nanni | 272/67 |
| 3,236,521 | 2/1966 | Knott | 273/96 |
| 4,218,057 | 8/1980 | Wilson | 272/117 |

FOREIGN PATENT DOCUMENTS

| | | | |
|---|---|---|---|
| 0855312 | 11/1960 | United Kingdom | 272/128 |

*Primary Examiner*—Stephen R. Crow
*Attorney, Agent, or Firm*—Christie, Parker & Hale

[57] ABSTRACT

An exercise wand and method are set forth which are particularly adapted to exercise the lower torso through twisting or bending. The wand includes a hollow tube having a closure at each end. The tube contains a plurality of movable spheres which extend 93% to 97% the length of the tube between the closures. Twisting or bending in a first direction shifts the spheres to abruptly engage and stack against a rigid closure at one end of the tube, the shifting spheres altering the center of mass for the wand and imparting momentum to the wand to urge full twisting or bending. Reverse twisting or bending shifts the spheres to abruptly engage a rigid closure at the other end of the tube, altering the center of mass and imparting momentum to the wand to urge full twisting or bending.

6 Claims, 1 Drawing Sheet

EXERCISE WAND AND METHOD

This application is a continuation in part of Ser. No. 06/885,222, filed Jul. 14, 1986, now abandoned.

FIELD OF THE INVENTION

This invention relates to exercise devices and, more particularly, to an exercise wand useful in twisting and bending exercises for the lower torso of the body.

BACKGROUND OF THE INVENTION

It is believed that twisting and bending exercises of the body can be of therapeutic effect to tone, strengthen, loosen and otherwise provide a health benefit to various parts of the body, including the legs, arms, shoulders, hips and, specifically, to the lower torso. By lower torso, what is meant is the lower back, including the spine and muscle groups, such as erector spinal, gluteus medius, illiac crest and lower abdomen, including the muscle groups of rectus abdominis, obliquus externus abdominis and connected ligaments. Twisting and bending of the upper body about the longitudinal axis, i.e., the axis extending from the top of the head through the body to the ground, has particular effect on the aforesaid muscles, ligaments and the spine. The longitudinal axis is contained in the median sagittal plane of the body which bisects the body front to back. This twisting or bending exercise may be for general health and muscle toning, or may be rehabilitative in nature to relieve back pain or to strengthen the back after an injury thereto.

One device according to the prior art which can be used by a twisting motion is disclosed in Dantolan, U.S. Pat. No. 2,528,213, issued Oct. 31, 1950. The device according to this reference is in the nature of a bar bell, including hand grips at each end of a member. A weight is slidably disposed on the member, spring cushions being provided at the handles to cushion the weight upon engagement thereof. To use the device in a twisting motion, the device is held at arm's length and the body is twisted. The weight moves back and forth between the handles being cushioned each time it engages a spring.

A drawback of this type of device is that often unusual strain on the back and shoulder muscles is imposed since the person must hold the device a distance away from the body, preferably at arm's length, so that the sliding weight may freely move. Since the muscles of the lower back are used to so position the device, these muscles are tensed which tends to prevent full twisting of the upper torso. Furthermore, the muscles of the shoulders and back may tire before a full therapeutic effect can be delivered to the lower torso. Additionally, since the device is held away from the body, the shoulders and arms may tend to move without inducing the desired full twisting of the lower torso. Full twisting is believed to be beneficial as both an exercise and to loosen or limber up the lower back and abdomen. As an added drawback, the springs of the Dantolan device act to absorb the momentum imparted to the traversing weight by the twisting motion and, hence, devices of this kind fail to take full advantage of that momentum to induce full twisting of the torso.

SUMMARY OF THE INVENTION

There is, therefore, provided according to the present invention an exercise wand which is simple and economical to make and use and which promotes the therapeutic twisting of the lower torso to its full extent. Also set forth is a method for exercising the lower torso using the exercise wand.

Toward this end, an exercise wand is set forth- which is particularly adapted for exercising the lower torso of the human body by twisting or bending about the body's longitudinal axis. The wand includes a hollow rigid tube having a length sufficient to extend a substantial distance to either side of the body's median sagittal plane when the tube is centered behind the neck and across the shoulders. The tube may be made of any suitable material, including metal or rigid plastic. The length and diameter of the tube are not critical. Lengths ranging from about four feet to about seven feet are preferred. Tubes having an inside diameter of from about 0.65 inch to about 1.15 inch are preferred.

A rigid closure is provided at each end of the tube and a plurality of spheres, e.g., made of metal, glass, ceramic, plastic or the like, are disposed in the tube. Each sphere has a diameter slightly less than the tube inside diameter to enable the spheres to move fully within the tube. The number of spheres is selected so as to fill the tube from about 93% to about 97% the length of the tube between the closures, and preferably about 96% of the length of the tube between the closures.

In the method of the invention, the tube is positioned behind the neck to conveniently lay across the person's shoulders. The torso is then twisted in a first rotational direction resulting in a rotation of the exercise wand. It is preferred that the head of the individual remain stationary as the torso is twisted. As rotation in the first direction reaches an end, the tube slows to a stop. As the tube slows, the spheres move within the tube to abruptly engage and stack against the end closure. This imparts momentum to the end of the wand to provide an extra "push" at the end of the rotation to urge more complete twisting or bending. The torso and wand is then twisted in the opposite rotational direction. As this rotation reaches an end, again the wand slows and the spheres move within in the tube in the opposite directions to abruptly engage and stack against the opposite end closure. The torso and wand are then rotated in the first direction back to the starting point and the cycle repeated. The speed of rotation is sufficient to provide from about 10 to about 45 and preferably from about 25 to about 35 complete cycles or repetitions per minute.

The movement of the spheres shifts back and forth the center of mass from one side of the median sagittal plane to the other, requiring different muscle groups to be tensed to maintain the wand in the proper position. Moreover, as twisting in a direction ends, the shifting of the spheres imparts momentum to the end of the wand to urge more complete and fuller twisting or bending of the body in that direction. Reverse twisting or bending moves the spheres in opposite direction to engage and stack against the opposite enclosure, shifting the center of mass and imparting momentum to induce fuller and more complete twisting or bending of the torso in that opposite direction. The exercises of this invention strengthen and tone the entire body and provide aerobic benefit to the cardiovascular system without the pounding associated with jogging or dance-type aerobic exercises.

BRIEF DESCRIPTION OF THE DRAWINGS

These and other features and advantages of the present invention would become appreciated as the same becomes better understood with reference to the specification, claims and drawings, wherein:

DETAILED DESCRIPTION

Figures 1, 2, 3:
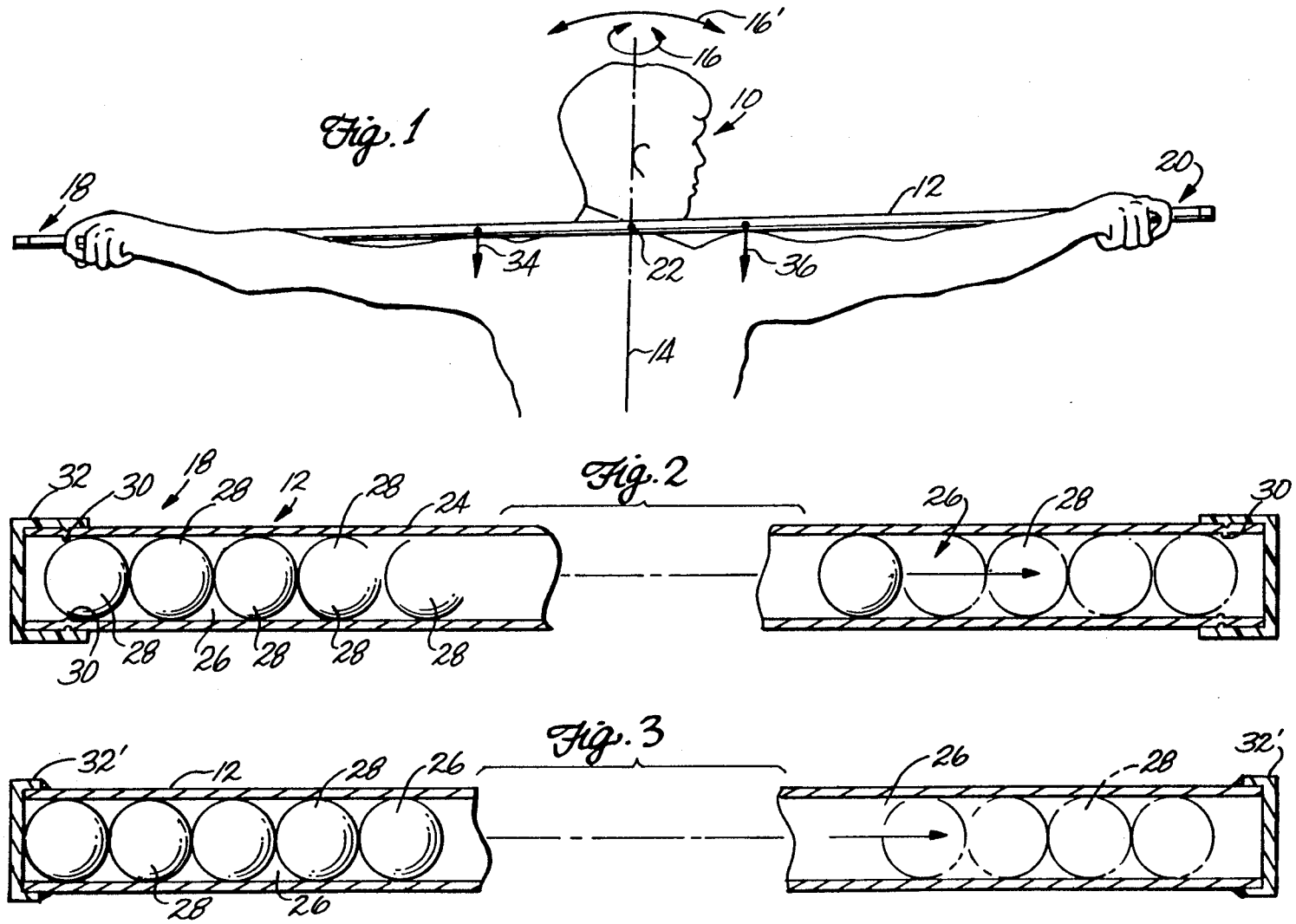
FIG. 1 is a rear view of an individual holding the exercise wand according to the present invention.
FIG. 2 is a side section view of one embodiment of the wand according to the present invention.
FIG. 3 is a side section view of yet another embodiment of the wand according to the present invention.

Turning to the drawings, FIG. 1 shows an individual 10 holding a wand 12 according to the present invention. Each individual has a longitudinal axis 14 which extends from the top of their head through their body and to the ground. This longitudinal axis is defined by the intersection of the body's median sagittal plane (a front-to-rear plane bisecting the body) and a coronal plane (the plane extending from side to side and bisecting the body). The wand 12 is particularly adapted for exercising the lower torso of the body during twisting about the longitudinal axis 14 in a first rotational direction and then a second opposite rotational direction, as indicated by arrow 16, or lateral bending of the body and the axis 14, as indicated by arrow 16. Such twisting or bending motion is believed to provide therapeutic and/or rehabilitative effects to the lower torso, which includes the lower back and lower abdomen.

As demonstrated in FIG. 1, the wand 12 has a length which can extend substantially to either side of the median sagittal plane and longitudinal axis 14, preferably comparable to an individual's arm span. Lengths of from about four feet to about seven feet are presently preferred—the smaller lengths being suitable for use by small adults and children, and the longer lengths being suitable for use by larger adults. As can be appreciated, wands 12 of such lengths can be conveniently positioned behind the neck to extend across the shoulders, the first and second ends 18 and 20 being gripped in the hands of the exerciser as shown. In the position shown in FIG. 1, the hands hold the wand behind the neck without significantly imposing strain upon the shoulders, upper arms or upper back. Midpoint 22 defines the mid-point for the wand 12 and, when the wand 12 is positioned behind the neck, lies substantially in the median sagittal plane.

As shown in FIG. 2, the wand 12 includes a hollow rigid tube 24 having a length as indicated above. The tube may be made of any suitable material, including metal such as steel, aluminum or rigid plastics. The diameter and wall thickness of the tube are not critical but are sufficient to prevent bending or buckling of the tube during use. Tubes having diameters greater than about 1.25 inches are not preferred because such tubes tend to be bulky and uncomfortable when positioned behind the neck and across the shoulders. Tubes having diameters less than about 0.75 inch are not preferred because they also tend to be uncomfortable during use and also tend to have insufficient strength to avoid bending or buckling. Diameters of from about 0.75 inch to about 1.25 inches and wall thickness of from about 0.049 inch to about 0.120 inch are presently preferred.

The inside diameter for the tube 24 defines a tubular channel 26 extending the entire length of the tube 24. Disposed within the channel 26 are a plurality of movable spheres or balls 28. The spheres 28 may be made out of metal, glass, ceramic, plastic or any other suitable material. Each of the spheres 28 has a diameter just less than of the tube inside diameter so that the spheres 28 move freely within the channel 26.

To retain the spheres 28 within the channel 26, a rigid closure means is provided at each end of the tube 24. The closure means, as shown in FIG. 2, may be embodied as one or a plurality of dimples 30 formed in the tube 24 which project into the channel 26 to define a space having a diameter less than that of the balls 28. Accordingly, as shown, the spheres at each end of the wand 12 abut and stack against the dimples 30, thereby retaining them within the channel 26. In the embodiment shown, a plastic closure cap 32 is provided at each end of the wand 12 to close the ends of the tube 24.

As shown in FIG. 3, the closure means may also be embodied as a rigid cap 32 welded or screwed to the ends of the tube. Other closure means, such as a pin extending across the channel 26, may be used if desired.

In use, the spheres 28 move between a first position wherein the spheres are stacked against the rigid closure means, e.g., dimple 30, at the first end 18 of the wand, and a second position stacked against the rigid closure means, e.g., dimple 30, at the opposite end 20 of the wand. The number of spheres 28 disposed in the channel 26 is critical and is selected so that, when stacked against one rigid closure, the spheres extend to fill from about 93% to about 97% of the length of the channel to the opposite rigid closure, and preferably from about 95% to about 96% of the length to opposite rigid closure. It has been found that, at the preferred cycle rates, if the number of spheres fills less than about 93% of this length, the spheres do not fully shift between their first to their second positions as twisting in one rotational direction stops and twisting in the opposite direction begins. Thus, the added momentum transferred to the end of the wand when the spheres shift to engage the opposite closure does not result and the benefits are not achieved, i.e., the extra "push" is not felt.

If the number of spheres fills more than about 97% of length between rigid closures, equally unsatisfactory results are achieved. Again, one does not feel the extra "push" at the end of each twist or turn. In such an arrangement, it is believed that the distance between the end of the stacked spheres and the opposite rigid closure is so small that the shift of the spheres from their first to second positions occurs before the tube slows appreciably at the end of the turn. Accordingly, the transfer of momentum from the spheres to the end of the wand is not felt as an extra "push" at the end of each twist or turn.

A number of spheres filling from about 95% to 96% of the length of the tube between rigid closures is presently preferred as the largest added "push" is felt at the end of each twist or turn at the preferred cycle rates. As exemplary only, a particularly preferred wand comprises a rigid steel tube having a length of 66 inches, an outer diameter of 0.75 inch and an inner diameter of 0.65 inch. Rigid closures in the form of dimples are provided about 0.31 inch from each end of the tube to provide a distance between dimples of 65.4 inches. Disposed within the interior channel of the tube between the tube are 100 steel spheres, each having a diameter of 0.625 inch. When stacked against one dimple, the spheres extend 95.5% of the length of the tube to the other dimple. The ends of the tube are covered by plastic caps.

During the twisting or bending exercise, the individual 10 twists in a first rotational direction and then in the opposite rotational direction about the longitudinal axis 14, the twisting and bending effect being focused upon the lower torso. Preferably the individual keeps his head stationary, does not rotate his head along with his torso. This is believed to provide better stretching of the muscle throughout the neck, upper back, and lower back region. Accordingly, while keeping his head stationary, the individual twists, for example, in a first direction from the start position to a first position representing the full amount of twist in that direction. This generally represents a rotation of from about 60° to 90°, depending on the flexibility of the individual. Thereafter, the individual twists in the opposite rotational direction to a second position representing the full amount of twist in that direction. Rotation from the first to second positions generally represents a rotation of from about 120° to about 180°. Rotation in the first direction back to the starting position represents one cycle.

To achieve the benefits of the exercise wand, the speed of rotation is sufficient to achieve from about 10 to about 45 cycles per minute of exercise, and preferably from about 25 to about 35 cycles per minute.

As can be appreciated, during this twisting or bending motion from the first position to the second position, the spheres 28 are caused to shift within the channel between the first and second ends 18 and 20 as illustrated in FIGS. 2 and 3. When, for example, the individual has twisted to the first position, the spheres 28 have moved to the position as shown in FIG. 2 to stack against one another and against the dimples 30 of the first end 18. In this position, with reference to FIG. 1, a first center of mass 34 is defined for the wand 12. Depending upon the number and weight of the spheres 28 this first center of mass 34 would be located at various degrees of distance from the median sagittal plane. Hence, to maintain the wand 12 in the proper position behind the neck and across the shoulders and in a relatively horizontal orientation, certain muscle groups must be tensed, at least slightly, including those of the left shoulder, right arm, upper back and lower torso. When the individual 10 twists or bends toward the second position, the spheres 28 traverse the channel 26 to engage and become stacked against the dimples 30 at the second end 20 of the wand. As the spheres 28 shift, the center of mass shifts across the median sagittal plane to define a second center of mass 36 located at the other side of the median sagittal plane as shown in FIG. 1. With the second center of mass 36 the reverse muscle groups must be tensed slightly to maintain the wand 12 in the desired position. Hence, the shifting center of mass provides some degree of exercise to the arms, shoulders, upper back and torso as the muscles work to maintain the wand in the desired position.

As the wand is rotated, momentum is imparted to the spheres. As the individual nears a position of full twist in one direction, the momentum of the tube decreases, i.e., the tube slows. However, the momentum of the spheres continues causing the spheres to move within the tube from one end to the other, abruptly engaging and stacking against the closure means at the other end. When the spheres engage the closure means, momentum is transferred to the tube, increasing its angular momentum. This urges the body to twist a bit more. This is felt as an extra "push" from the wand at the end of each twist or turn. The shifting of the momentum assures that the individual obtains a full degree of twist and hence achieves the maximum therapeutic benefit.

As can be appreciated, the twisting or bending causes the spheres 28 to shift defining alternate first and second center of masses 34 and 36 for the wand 12. The shifting of the spheres also, by virtue of the rigid closure means, imparts to the maximum extent possible momentum to assure that the individual obtains a full twist in each of the rotational directions.

While the invention has been described with reference to certain embodiments shown in the drawings, it is to be understood that it is subject to many modifications without departing from the spirit and scope of the invention as set forth in the appended claims.

What is claimed is:

1. An exercise wand particularly adapted for exercising the lower torso of the human body by twisting or bending about the body's longitudinal axis between a first and a second position, the wand comprising:
   - a hollow tube having a length of from about 4 to about 7 feet and an inside diameter;
   - a rigid closure at each end of the tube; and
   - a plurality of weighted spheres disposed in the tube for freely shifting between the closures, each sphere having a diameter just less than the tube inside diameter, the number of spheres being selected so that the spheres are stacked against one another and against one closure, the spheres extend a distance of from about 94% to about 97% of the distance between the closures.

2. The wand of claim wherein the number of spheres is selected so that when the spheres are stacked against one another and against one closure, the spheres extend a distance of from about 95% to about 96% of the distance between the closures.

3. The wand of claim 1 wherein the tube has a diameter of from about 0.75 inch to about 1.25 inch.

4. The wand of claim 1 wherein each rigid closure is at least one dimple projecting into the tube diameter to rigidly stop the shifting spheres.

5. The wand of claim 4 further including a removable cap at each end of the wand.

6. An exercise wand particularly adapted for exercising the lower torso of the human body by twisting or bending about the body's longitudinal axis between a first and a second position, the wand comprising:
   - a hollow tube having a length of from about 4 to about 7 feet and an inside diameter;
   - a rigid closure at each end of the tube; and
   - means disposed in the hollow tue for freely shifting between each closure in response to movement of the tube, the means for freely shifting comprising a plurality of weighted spheres disposed in the tube between the closures, each sphere having a diameter just less than the tube inside diameter, the number of spheres being selected so that the spheres are positioned against one another and against one closure, wherein the spheres extend a distance of from about 94% to about 97% of the distance between the closures and the closures are adapted for rigidly stopping shifting of the spheres by contact therewith.

* * * * *